US008226086B2

(12) United States Patent
Schulte

(10) Patent No.: US 8,226,086 B2
(45) Date of Patent: Jul. 24, 2012

(54) COMPLETE INNER AND OUTER JIGSAW PUZZLE

(75) Inventor: William C. Schulte, Cincinnati, OH (US)

(73) Assignee: Late for the Sky Productions Co., Inc., Cincinnati, OH (US)

( * ) Notice: Subject to any disclaimer, the term of this patent is extended or adjusted under 35 U.S.C. 154(b) by 0 days.

(21) Appl. No.: 13/239,836

(22) Filed: Sep. 22, 2011

(65) Prior Publication Data

US 2012/0007310 A1 Jan. 12, 2012

Related U.S. Application Data

(63) Continuation of application No. 12/365,229, filed on Feb. 4, 2009, now Pat. No. 8,083,233.

(51) Int. Cl.
*A63F 9/10* (2006.01)

(52) U.S. Cl. ..... 273/157 R

(58) Field of Classification Search ..... 273/157 R, 273/157 A; D21/480
See application file for complete search history.

(56) References Cited

U.S. PATENT DOCUMENTS

| | | | |
|---|---|---|---|
| 760,384 | A | 5/1904 | Dietrich |
| 2,037,966 | A | 4/1936 | Dailey |
| 2,506,189 | A | 5/1950 | Attridge |
| 3,433,485 | A | 3/1969 | Renn et al. |
| 3,575,418 | A | 4/1971 | Palmer |
| 4,776,802 | A | 10/1988 | Rind et al. |
| 4,792,138 | A | 12/1988 | Watkins |
| 5,022,655 | A | 6/1991 | Meyer |
| 5,149,098 | A | 9/1992 | Bianchi |
| 5,368,301 | A | 11/1994 | Mitchell |
| 6,012,718 | A | 1/2000 | McClellan |
| 6,024,360 | A | 2/2000 | Orbach et al. |
| 6,672,588 | B1 | 1/2004 | Kielar et al. |
| 6,702,586 | B1 | 3/2004 | Miller |
| 2006/0170156 | A1 | 8/2006 | Fabrige |

OTHER PUBLICATIONS

International Search Report and Written Opinion from related PCT Application No. PCT/US2010/021697 mailed Mar. 18, 2010 (8 pages).

http://www.horse.com/Sedona-Gallop-Horse-Jigsaw-Puzzle-GBL14.html, printed Jan. 28, 2009 (2 pages).

*Primary Examiner* — Steven Wong

(74) *Attorney, Agent, or Firm* — Wood, Herron & Evans, LLP

(57) ABSTRACT

A jigsaw puzzle is provided with a plurality of inner puzzle pieces defining a complete inner jigsaw puzzle depicting a preselected object, and a plurality of outer puzzle pieces defining a complete outer jigsaw puzzle depicting a frame around an opening having the shape of the preselected object.

9 Claims, 6 Drawing Sheets

COMPLETE INNER AND OUTER JIGSAW PUZZLE

CROSS-REFERENCE TO RELATED APPLICATIONS

This application is a continuation of U.S. patent application Ser. No. 12/365,229, filed Feb. 4, 2009, the disclosure of which is hereby incorporated by reference in its entirety.

TECHNICAL FIELD

The present invention relates to jigsaw puzzles.

BACKGROUND

Jigsaw puzzles are well-known and have been in existence for many years. A typical, traditional jigsaw puzzle comprises an image which is laminated onto a material, usually cardboard or wood. The laminated material is cut or cast into a number of interlocking pieces, such that they can be reassembled into a completed puzzle displaying the image. A set of the pieces, sometimes referred to as edge pieces, define the outer periphery of the puzzle when assembled. That outer periphery is a generally continuous edge, and may often be rectangular, although other geometric or even irregular shapes may be defined. Depending on the number, size, and similarity of the interlocking pieces and the artwork, the level of difficulty can be adjusted for any kind of puzzle consumer.

SUMMARY OF THE INVENTION

I have developed jigsaw puzzles that provide multiple levels of challenge and entertainment. To that end, and in accordance with the principles of the present invention, I have developed a puzzle within a puzzle, wherein the plurality of inner puzzle pieces when assembled define a complete puzzle depicting an object and the edge pieces of the inner puzzle define an outer periphery conforming to the shape of the object, and wherein the plurality of outer puzzle pieces, when assembled, define a frame for the inner puzzle with an opening having a shape conforming to the object, such that the assembled inner puzzle nests into the outer puzzle or frame. The pieces of the outer puzzle may thus include edge pieces which define the outer periphery thereof and internal boundary pieces defining the inner edge boundary of the opening. The frame may have a color or colors which complement the image of the object in the inner puzzle. In an exemplary embodiment, the object is a football helmet, such that the outer periphery of the inner puzzle corresponds to the shadow image of the helmet. In that exemplary embodiment, the image on the frame may relate to the helmet such as by utilizing in the outer puzzle the color or colors corresponding to the team color(s) of the football helmet depicted in the inner puzzle.

By virtue of the foregoing, there are provided jigsaw puzzles that provide multiple levels of challenge and entertainment. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description given above and the detailed description given below, serve to explain various aspects of the invention.

DETAILED DESCRIPTION

Figure 1:
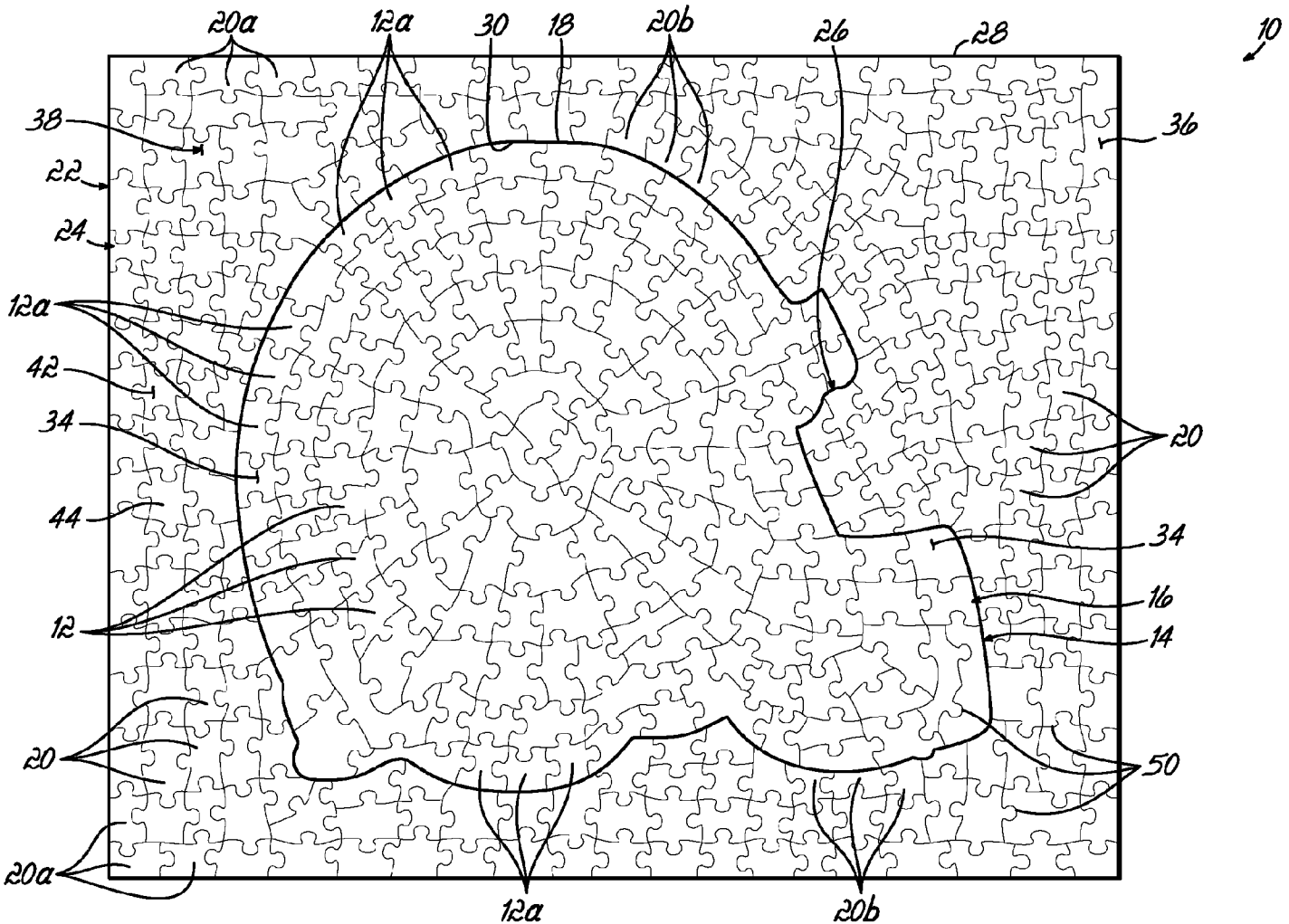
FIG. 1 is a front view of a jigsaw puzzle, showing a plurality of inner puzzle pieces fully assembled into a completed inner puzzle and a plurality of outer puzzle pieces fully assembled into a completed outer puzzle with the former nested in the latter, all in accordance with the principles of the present invention.
Figure 2:
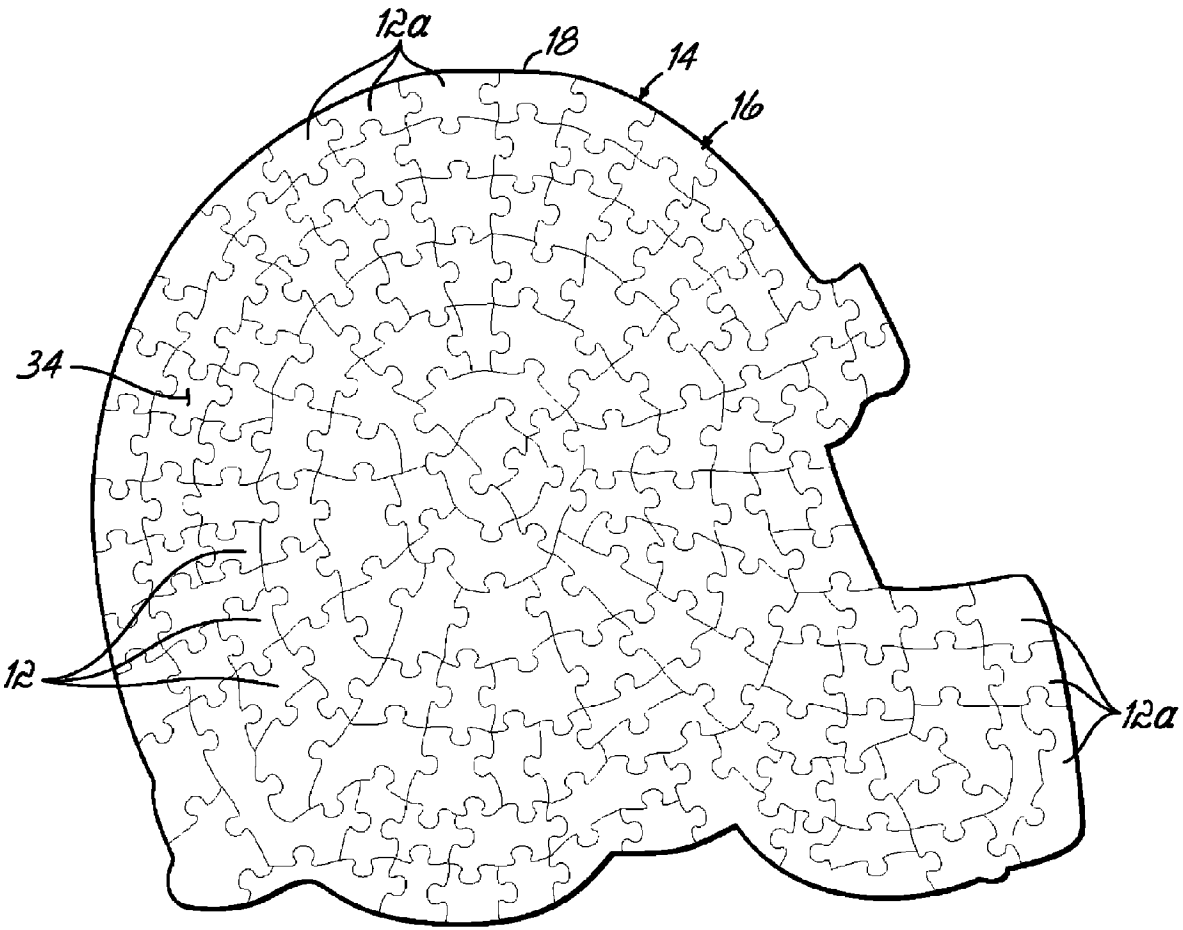
FIG. 2 is a front view of the completed inner puzzle of FIG. 1.
Figure 3:
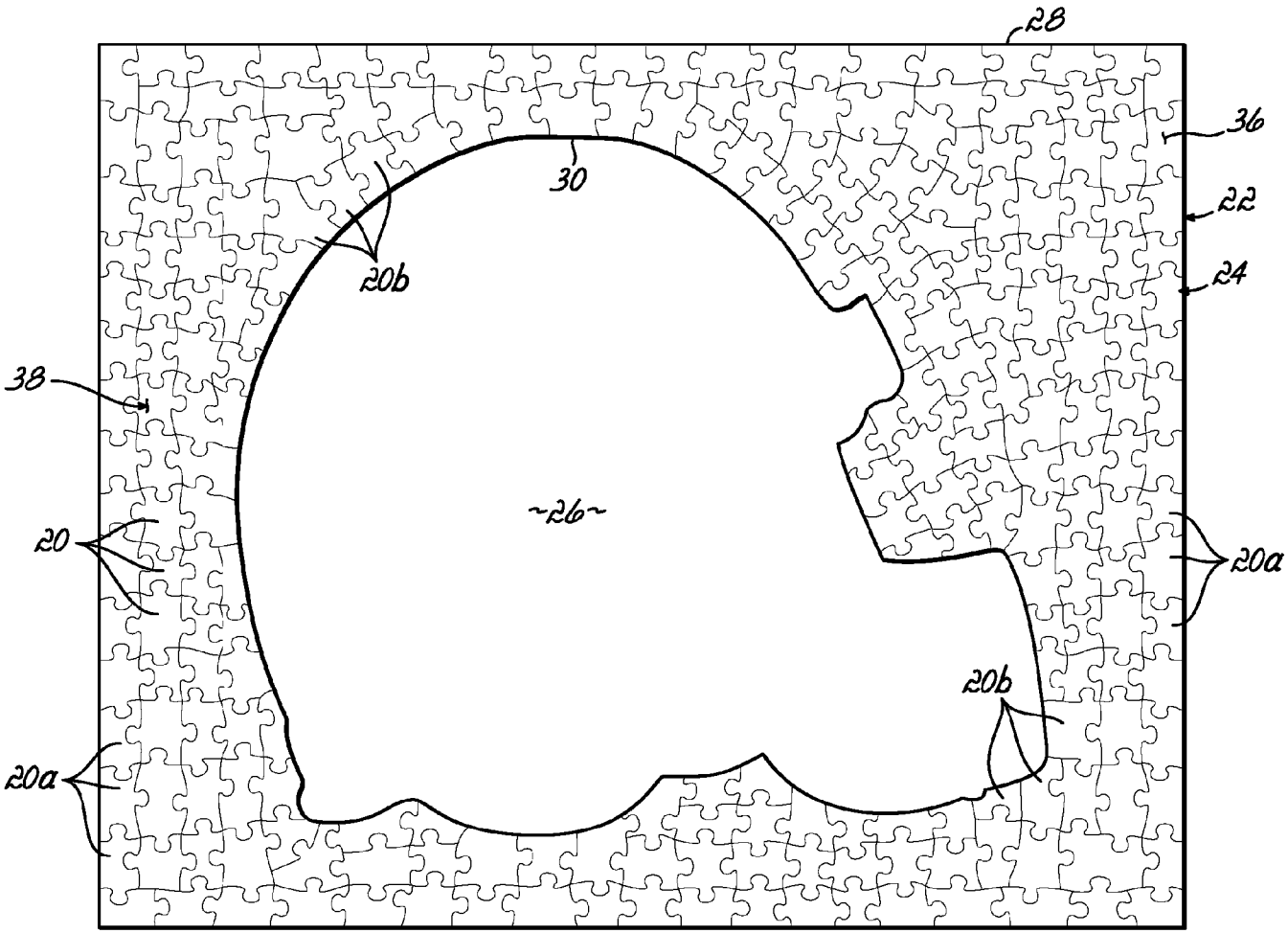
FIG. 3 is a front view of the completed outer puzzle of FIG. 1.

Referring now to the drawings, and specifically FIGS. 1-3, an exemplary jigsaw puzzle 10 according to the principles of the present invention is disclosed. Jigsaw puzzle 10 includes a plurality of inner puzzle pieces 12 including edge pieces 12*a*. Pieces 12 and 12*a* are shown assembled so as to define a complete inner puzzle 14 depicting an image of a preselected object 16, in this case of a football helmet, with the edge pieces 12*a* defining a generally continuous outer periphery 18 of inner puzzle 14 corresponding to the shadow of the image of object 16 which, as seen more clearly in FIG. 2, reflects a football helmet. As can be seen in FIG. 2, inner puzzle 14 is a complete puzzle in its own right.

Jigsaw puzzle 10 further includes a plurality of outer puzzle pieces 20 defining a complete outer puzzle 22 in the shape of a frame 24 around an opening 26 (FIG. 3). The outer periphery 28 of frame 24 is defined by outer edge pieces 20*a*, which in this embodiment defines a generally continuous rectangular outline, whereas opening 26 has a generally continuous inner edge boundary 30 defined by inner boundary pieces 20*b* which, when assembled, also have the shape of preselected object 16. When inner puzzle pieces 12 and outer puzzle pieces 20 are assembled together as shown in FIG. 1, inner puzzle 14 nests within outer puzzle 22 to define puzzle 10. Advantageously, outer periphery 18 of inner puzzle 14 and inner edge boundary 30 of outer puzzle 22 are substantially adjacent.

Advantageously, no individual edge piece 12*a* along the outer periphery 18 has a projection or recess adapted to interlockingly mate with a corresponding recess or projection of any individual inner boundary piece 20*b* along the inner edge boundary 30, such that the inner and outer puzzles 14 and 22 may be seen as self-contained and complete puzzles in their own right. However, groups of pieces 12*a* of outer periphery 18 and/or pieces 20*b* of inner edge boundary 30 may define projections and/or recesses of the preselected object 16, as may be understood by reference to FIGS. 2 and 3.

Puzzle 10 may be completed in many ways, some examples of which include: (a) inner puzzle 14 may be first assembled, and then outer puzzle 22 assembled therearound; (b) inner and outer puzzles 14 and 22 may be separately assembled, in either order, and then inner puzzle 14 placed into opening 26 of outer puzzle 22; (c) outer puzzle 22 may be first assembled and then inner puzzle 14 assembled within opening 26; (d)

both inner and outer puzzles 14 and 22 may be assembled piecemeal as one larger puzzle 10, and/or (e) only inner puzzle 14 or only outer puzzle 22 may be assembled, thus providing various levels of jigsaw challenges.

As will be readily appreciated, when inner puzzle 14 is assembled, object 16 defines a first image on one side, such as the front face 34, thereof. Similarly, when assembled, outer puzzle 22 may define a frame image 36 on the front face 38 thereof. That frame image 36 would typically not be a physical extension of object 16 so as to be apparent that outer puzzle 22 defines a puzzle separate from inner puzzle 14. Advantageously, frame image 36 will relate to object 16 in some recognizable way, however. In the embodiment shown, for example, frame image 36 may be comprised of at least one team or school color of the football helmet represented by object 16. By way of example and not limitation, if the first image making up inner puzzle 14 is a representation of a Florida Gators football helmet, the helmet may be orange with the blue script wording for "gators" thereon, and the frame image 36 of outer puzzle 22 may be all orange and may, additionally, depict a green alligator (not shown). As another example, if the first image making up inner puzzle 14 is a representation of a football helmet of The Ohio State Buckeyes, the helmet may be gray with a scarlet stripe running front to back (with adjacent black and white stripes), with the frame image 36 being made up of the school colors of scarlet and/or gray.

Figure 3A:
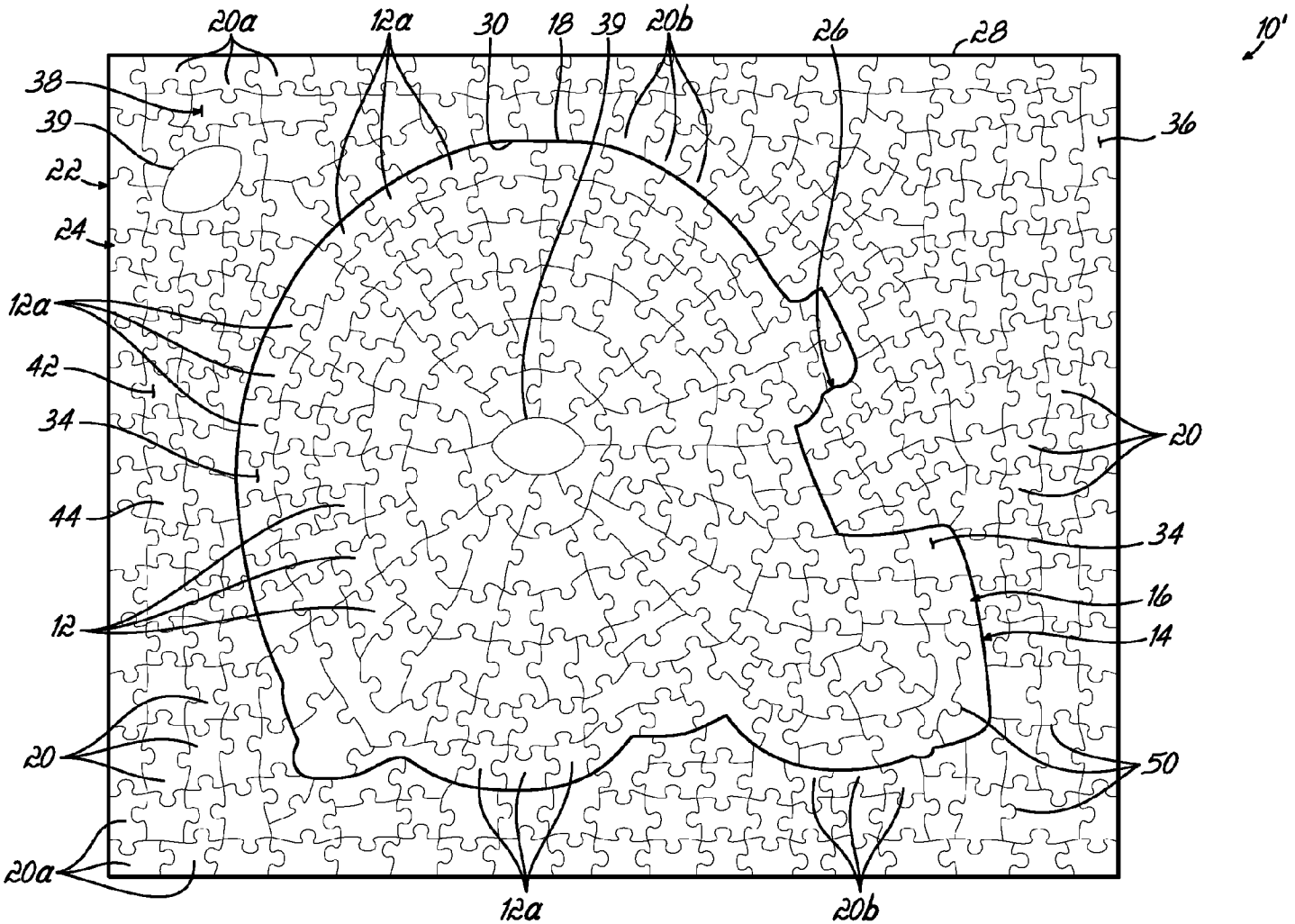
FIG. 3A is a front view of an alternative version of the completed inner and outer puzzles of FIG. 1.

In addition to the foregoing, it may be desirable to include self-contained puzzle pieces in either the inner puzzle 14 and/or the outer puzzle 22 which relates to the image 16 of the inner puzzle 14. By way of example, FIG. 3A shows an alternative puzzle 10' quite like puzzle 10 of FIG. 1 but with one or more special self-contained pieces 39 (two shown). In that regard, where the image 16 is of a football helmet, at least one, but possibly more than one if desired, self-contained football shaped puzzle pieces 39 may be included in inner puzzle 14 and/or outer puzzle 22. In FIG. 3A, a piece 39 is shown in each of puzzles 14 and 22, but it will be appreciated that only one of them, either inner puzzle 14 or outer puzzle 22, might be adapted to contain self-contained piece 39.

Figure 4:
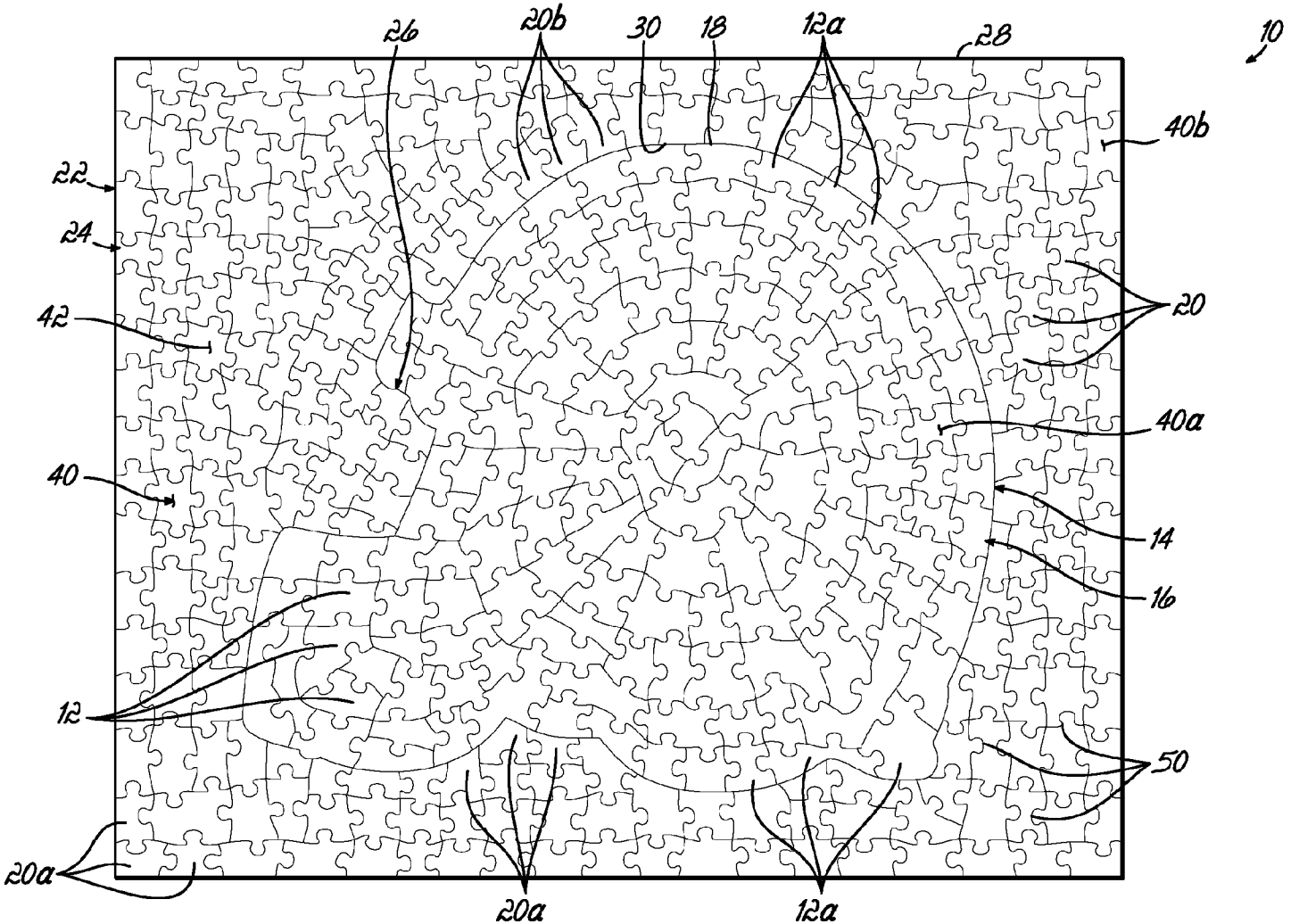
FIG. 4 is a rear view of one embodiment of the jigsaw puzzle of FIG. 1.

As will be readily appreciated, in many jigsaw puzzles, the opposite or back face 40 will simply be a bland color, such as that of the cardboard or wood backing on which the first and/or frame image(s) is provided, such that a rear view of the completed puzzle would merely show the overall shape of the puzzle 10 with the score lines 50 for the pieces, as shown in FIG. 4. In accordance with an alternative or additional aspect of the present invention, a complete second puzzle image 42 may be provided on back faces 40*a* and 40*b* of both inner and outer puzzle pieces 12 and 20, respectively, such that when all of the pieces 12 and 20 are assembled, a complete, second puzzle with its own, second image 42 is presented. Thus, while the plurality of inner puzzle pieces 12 comprise a front face 34 collectively forming a first image 16 when fully assembled, and the plurality of outer puzzle pieces 20 comprises a front face 38 collectively forming a frame image 36 when fully assembled, the back faces 40*a*, 40*b* of all of the inner and outer pieces 12 and 20 collectively define a second image 42 to thus provide yet a further alternative puzzle challenge.

Figure 5:
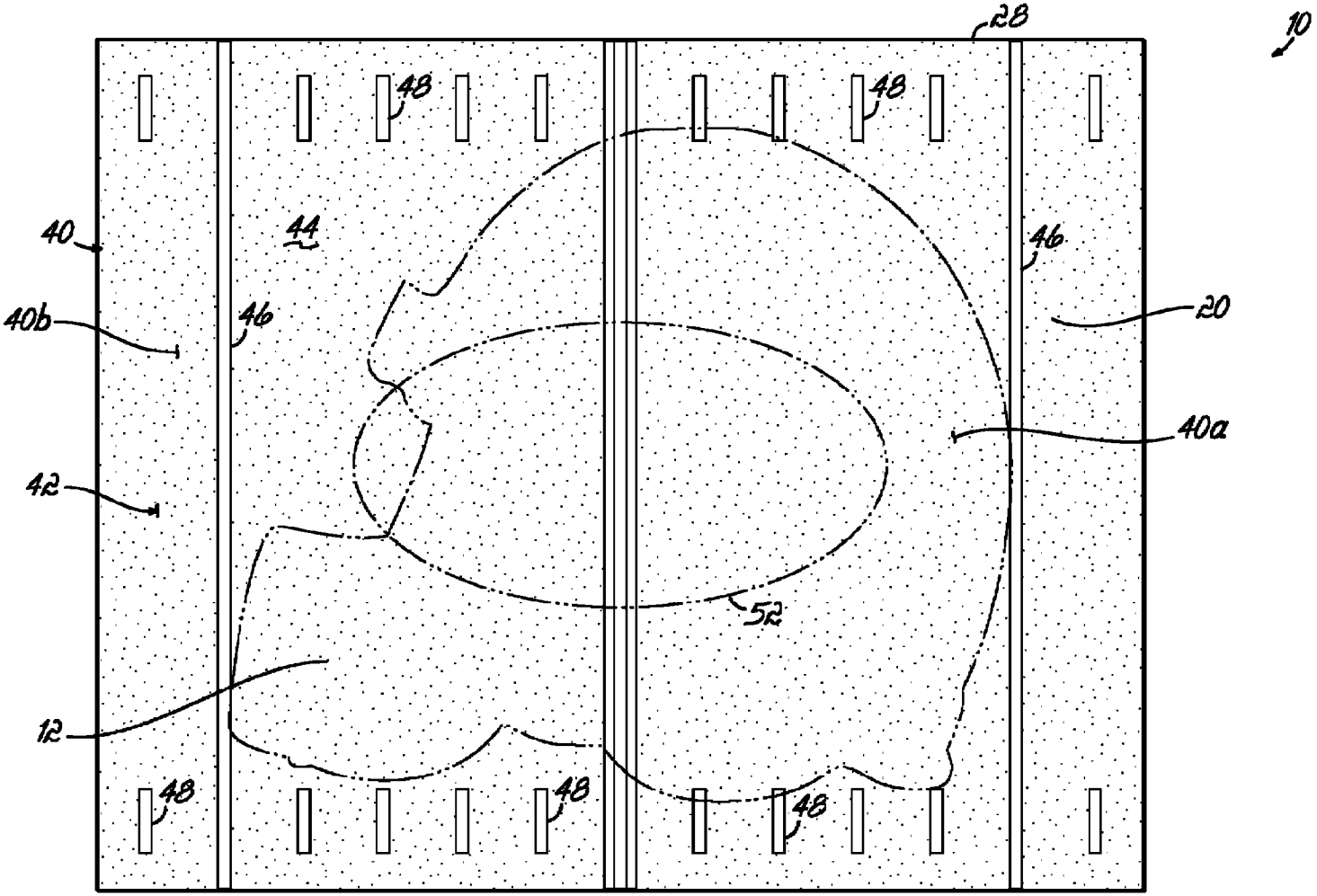
FIG. 5 is a rear view of an alternative embodiment of the jigsaw puzzle of FIG. 1 showing the plurality of inner puzzle pieces and outer puzzle pieces fully assembled to collectively form an image in accordance with another aspect of the present invention.

While not necessary, in a particularly advantageous embodiment of puzzle 10, second image 42 may relate to first image 16 on the front face 34 of inner puzzle 14. In the embodiment shown where first image 16 is of a football helmet, second image 42 may be representative of a football field, or a portion thereof, and may include indicia representative of that team or the field on which the team represented by that helmet plays their home games, for example. In that regard, and with reference to FIG. 5, in one exemplary embodiment, second image 42 may reflect turf as at 44, and some yard lines and hash marks as at 46 and 48, respectively, to represent all or part of a football field, and may also include the team insignia or other markings as at 52 representative of that team and/or which might be on the home field for that team. By way of example and not limitation, in the Florida Gators example given above, second image 42 may also include a head of an alligator at 52 representing the team logo, and in The Ohio State Buckeyes example given above, second image 42 may also include the OSU Athletic logo (gray "O" with scarlet arch lettering of "Ohio State" therethrough) at 52. Thus, it will be seen that while the front face(s) 34 and 38 of puzzles 14 and 22 provide two different, complete puzzles, it is the combination of both puzzles 14 and 22 that are required to create a complete puzzle with image 42.

By virtue of the foregoing, there are thus provided jigsaw puzzles that provide multiple levels of challenge and entertainment.

While the present invention has been illustrated by a description of embodiments thereof, and while these embodiments have been described in considerable detail, it is not the intention of the applicant to restrict or in any way limit the scope of the appended claims to such detail. Additional advantages and modifications will readily appear to those skilled in the art. For example, while preselected object 16 is advantageously a football helmet, which has been shown merely by way of example to help explain the principles of the present invention, object 16 can be some other sports-related object (non-limiting examples of which include a hockey stick, a baseball bat, a baseball cap), although it will be appreciated that object 16 need not be a sports object at all. As an example, object 16 might be a dog or other animal. In that situation, as an example, piece(s) 39 could be in the shape of a bone. Moreover, in those embodiments where there is provided a second image 42 corresponding to the first image 16, the frame image 32 need not be related or otherwise correspond to first image 16, and might even simply be a white border. Also, the outer periphery 28 of frame 24 need not be rectangular, but could be some other outline or shape as desired. Further, frame image 36 could be made up of multiple colors representing the image depicted in object 16. The invention in its broader aspects is, therefore, not limited to the specific details, representative apparatus, or illustrative examples shown and described. Accordingly, departures may be made from such details without departing from the spirit or the scope of the general inventive concept.

What is claimed is:

1. A jigsaw puzzle comprising:

a plurality of loose, independent inner puzzle pieces contiguously interconnectable to define a complete inner jigsaw puzzle having an image depicting a preselected object having a peripheral edge shape, a first plurality of the inner puzzle pieces being edge pieces interconnectable to define a generally continuous, irregular peripheral outline conforming to the peripheral edge shape of the preselected object and surrounding a second plurality of the inner puzzle pieces; and a plurality of loose, independent outer puzzle pieces contiguously interconnectable to define a complete outer jigsaw puzzle depicting a frame around a single opening having the shape of the preselected object's peripheral edge shape, a first plurality of the outer puzzle pieces interconnectable to define a generally continuous inner edge boundary forming the single opening, a second plurality of the outer puzzle pieces being situatable outboard of the first plurality of the outer puzzle pieces such that, upon assembly, the plurality of inner puzzle pieces is completely surrounded by the first plurality of outer puzzle pieces, wherein no edge piece along the continuous, irregular peripheral outline has a projection or recess adapted to interlockingly mate with a corresponding recess or projection of any individual inner boundary piece along the continuous inner edge boundary.

2. The jigsaw puzzle of claim 1, wherein the complete inner jigsaw puzzle properly assembled interfits within the single opening of the complete outer jigsaw puzzle properly assembled so that the continuous, irregular peripheral outline and the continuous inner edge boundary are substantially adjacent to each other.

3. The jigsaw puzzle of claim 1, wherein the plurality of outer puzzle pieces defines a generally continuous, rectangular outline when properly assembled.

4. The jigsaw puzzle of claim 1, wherein the preselected object is a football helmet, the continuous, irregular peripheral outline corresponding to a silhouette shape of the helmet.

5. The jigsaw puzzle of claim 1, wherein the plurality of outer puzzle pieces comprises pieces of at least one color adapted to complement the complete inner jigsaw puzzle properly assembled.

6. The jigsaw puzzle of claim 5, wherein the preselected object is a football helmet, and the at least one color of the plurality of outer puzzle pieces includes a team color corresponding to the team that wears the football helmet depicted by the image of the complete inner jigsaw puzzle properly assembled.

7. The jigsaw puzzle of claim 1, wherein the plurality of puzzle pieces includes at least one self-contained piece having a shape related to the preselected object depicted by the image of the complete inner jigsaw puzzle properly assembled.

8. The jigsaw puzzle of claim 7 wherein the preselected object is a football helmet, the at least one piece being football shaped.

9. The jigsaw puzzle of claim 1, the plurality of inner puzzle pieces and the plurality of outer puzzle pieces each including at least one self-contained piece having a shape related to the preselected object depicted by the image of the complete inner jigsaw puzzle properly assembled.

* * * * *